US006439563B1

(12) United States Patent
Kayani

(10) Patent No.: US 6,439,563 B1
(45) Date of Patent: Aug. 27, 2002

(54) NOTE FEEDER

(75) Inventor: Sohail Kayani, Irving, TX (US)

(73) Assignee: Currency Systems International, Inc., Irving, TX (US)

( * ) Notice: Subject to any disclaimer, the term of this patent is extended or adjusted under 35 U.S.C. 154(b) by 0 days.

(21) Appl. No.: 09/484,309

(22) Filed: Jan. 18, 2000

(51) Int. Cl.[7] ..... B65H 5/00

(52) U.S. Cl. ..... 271/10.03; 271/11; 271/94; 271/104; 271/34; 271/111; 271/265.02; 271/122

(58) Field of Search ..... 271/11, 12, 10.02, 271/10.03, 94, 104, 34, 122, 110, 111, 265.02, 265.01, 270

(56) References Cited

U.S. PATENT DOCUMENTS

| | | | | | |
|---|---|---|---|---|---|
| 3,222,057 | A | | 12/1965 | Couri | |
| 3,759,382 | A | | 9/1973 | Walkley | |
| 3,981,493 | A | * | 9/1976 | Klappenecker et al. | 271/111 |
| 4,451,027 | A | * | 5/1984 | Alper | 271/122 |
| 4,465,192 | A | | 8/1984 | Chba | |
| 4,494,744 | A | * | 1/1985 | Povio et al. | 271/34 |
| 4,561,644 | A | * | 12/1985 | Clausing | 271/34 |
| 4,587,434 | A | | 5/1986 | Roes | |
| 4,602,149 | A | | 7/1986 | Tateisi | |
| 4,643,412 | A | * | 2/1987 | Heina et al. | 271/34 |
| 4,845,917 | A | | 7/1989 | Cmura | |
| 5,012,932 | A | | 5/1991 | Cmura | |
| 5,022,531 | A | | 6/1991 | Horino | |
| 5,054,621 | A | | 10/1991 | Murphy | |
| 5,105,364 | A | | 4/1992 | Kawamura | |
| 5,129,641 | A | * | 7/1992 | Long | 271/10.03 |
| 5,182,722 | A | | 1/1993 | Hain | |
| 5,201,424 | A | | 4/1993 | Hain | |
| 5,310,062 | A | | 5/1994 | Stevens | |
| 5,394,992 | A | | 3/1995 | Winkler | |
| 5,443,359 | A | * | 8/1995 | Miller et al. | 271/111 |
| 5,529,211 | A | | 6/1996 | Ishiwata | |
| 5,673,333 | A | | 9/1997 | Johnston | |
| 5,678,817 | A | * | 10/1997 | Saito et al. | 271/122 |
| 6,168,146 | B1 | * | 1/2001 | Komuro et al. | 271/122 |
| 6,234,470 | B1 | * | 5/2001 | Okitsu et al. | 271/122 |

FOREIGN PATENT DOCUMENTS

| | | | | |
|---|---|---|---|---|
| GB | 2126991 A | * | 4/1984 | 271/10.03 |
| WO | WO 92/16444 | * | 10/1992 | 271/111 |

* cited by examiner

*Primary Examiner*—H. Grant Skaggs
(74) *Attorney, Agent, or Firm*—Colin P. Cahoon; Carstens, Yee & Cahoon, LLP

(57) ABSTRACT

A method and apparatus for feeding a currency note into a currency processing machine. This note feeder includes a transporter for transporting notes from a note stack onto a processing belt inside the currency processing machine. The note feeder also includes a mediating transporter that takes the note from the transporter and feeds the note onto the processing belt. The note feeder also includes sensors for determining when the note has left a first feeding area and entered a second feeding area and a sensor that determines when the note has entered onto the processing belt. Based on information received from the sensors, the transporter starts and stops thus providing uniform spacing between notes.

17 Claims, 2 Drawing Sheets

NOTE FEEDER

BACKGROUND OF THE INVENTION

1. Technical Field

The present invention pertains in general to a document handling system and, more particularly, to a system of feeding notes into a high speed currency processing machine.

2. Description of the Related Art

After currency is distributed in the public sector, it will typically find its way back into the banking institutions. This is facilitated through individuals depositing currency documents in their local banking institutions, and businesses forwarding their cash receipts to the banking institutions. Once the banking institutions have received the currency in the form of the notes, these notes must then be processed. To facilitate the large number of notes that must be sorted, counted and then re-bundled or "strapped" for distribution back to the banks, large high speed currency processing machines have been developed.

Currency processing machines, such as those developed and manufactured by Currency Systems International of Irving, Tex., typically have a feeder slot into which stacks of currency, sometimes in different denominations and even different sizes, can be placed. The currency processor will then individually strip the notes or documents from the feeder slot, pass them along a high speed conveyer past various sensing stations to determine the denomination, authenticity, and the quality or integrity of the note. Once this is done, then the currency processing machine will deposit each note processed in a collection bin associated with the proper denomination. Typically, a separate collection bin is provided for notes that are defective due to, for example, a tear or excessive wear, and another collection bin is provided for counterfeit notes. These processing machines can process notes at rates up to 2,400 notes per minute.

A prior art currency note feeder for feeding currency into these sorting machines is depicted in FIG. 1. A shuttle 120 picks up a note 180 from the stack of notes 160 by creating a vacuum between the note 180 and the transporter 120. The vacuum is created by a vacuum hose 130. The shuttle 120 then physically moves laterally to move the note 180 onto a transport belt (not shown). Often times a second note 170 is picked by the shuttle 120 along with the note 180 of interest. A stationary vacuum 110 is situated down stream from the stack of notes 160. The stationary vacuum 110 creates a vacuum on a side of the first note 180 opposite from the side of the first note 180 in contact with the shuttle 120. This stationary vacuum 110 picks off any stray notes such as the note 170 that may be stuck to the note 180 of interest, thus insuring that only one note at a time is fed into the currency sorting machine.

One problem encountered with present currency processing machines, such as depicted in FIG. 1, is that a batch of heavily soiled, worn, or torn notes requires more spacing between notes to adequately process the notes and to avoid jams in the currency processor. However, the current method and apparatus does not have any mechanism to adjust the spacing between notes such that such problems can be avoided. All that can be done with the present system is to increase or decrease the rate of notes processed, but this may not efficiently address the problems. Furthermore, current note feeders such as depicted in FIG. 1 are mechanical devices with coordinated vacuum and shuttle, which are hard to control with precision. It is not always possible to maintain the exact spacing with currently available note feeders nor is it possible to control the speed of note throughput or the spacing between notes in real time. Furthermore, the stationary vacuum 110 does not strip the second note 170 every time. Therefore, it would be beneficial to have a note feeder that maintains a constant note separation and that can adjust note separation and speed in real time based on occurrences within the currency sorting machine, thus avoiding the problems with the present system.

SUMMARY OF THE INVENTION

The present invention provides a method and apparatus for feeding a currency note into a currency processing machine. The note feeder includes a transporter in a first feeder section for transporting a first note from a stack of notes onto a transport belt. A first sensor in a second feeder section identifies the presence of the first note in the second feeder section. A reversing transporter removes extra notes from the first note as the note enters into a second feeder section. The reversing transporter may rotate continuously until the first note reaches the second sensor, thus providing a more efficient note separation. A mediating transporter moves the first note from the transporter onto a processing belt. A second sensor in the second feeder section identifies when the first note has reached the processing belt and when the note has left the second feeder section.

In a preferred embodiment, the transporter sits idle after the first note reaches the mediating transporter and restarts after the first note reaches the processing belt. In this manner, the spacing between consecutive notes is maintained at a constant distance. The transporter is also under the electronic control of the currency processing machine. If the currency processing machine determines that the spacing between successive notes needs to be adjusted because of a slow down in processing down stream, the transporter can be set to wait a predetermined time after the first note enters the processing belt before restarting and sending the next note. Thereby, the spacing between successive notes is adjusted. This control of the spacing between successive notes prevents jams in the currency processing machine which are not avoidable with the prior art where the transporter is purely mechanical and not under control of the currency processing machine. This adjustment of the spacing between successive notes takes place in real time. Furthermore, real time adjustment of the note speed is also provided.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 2:
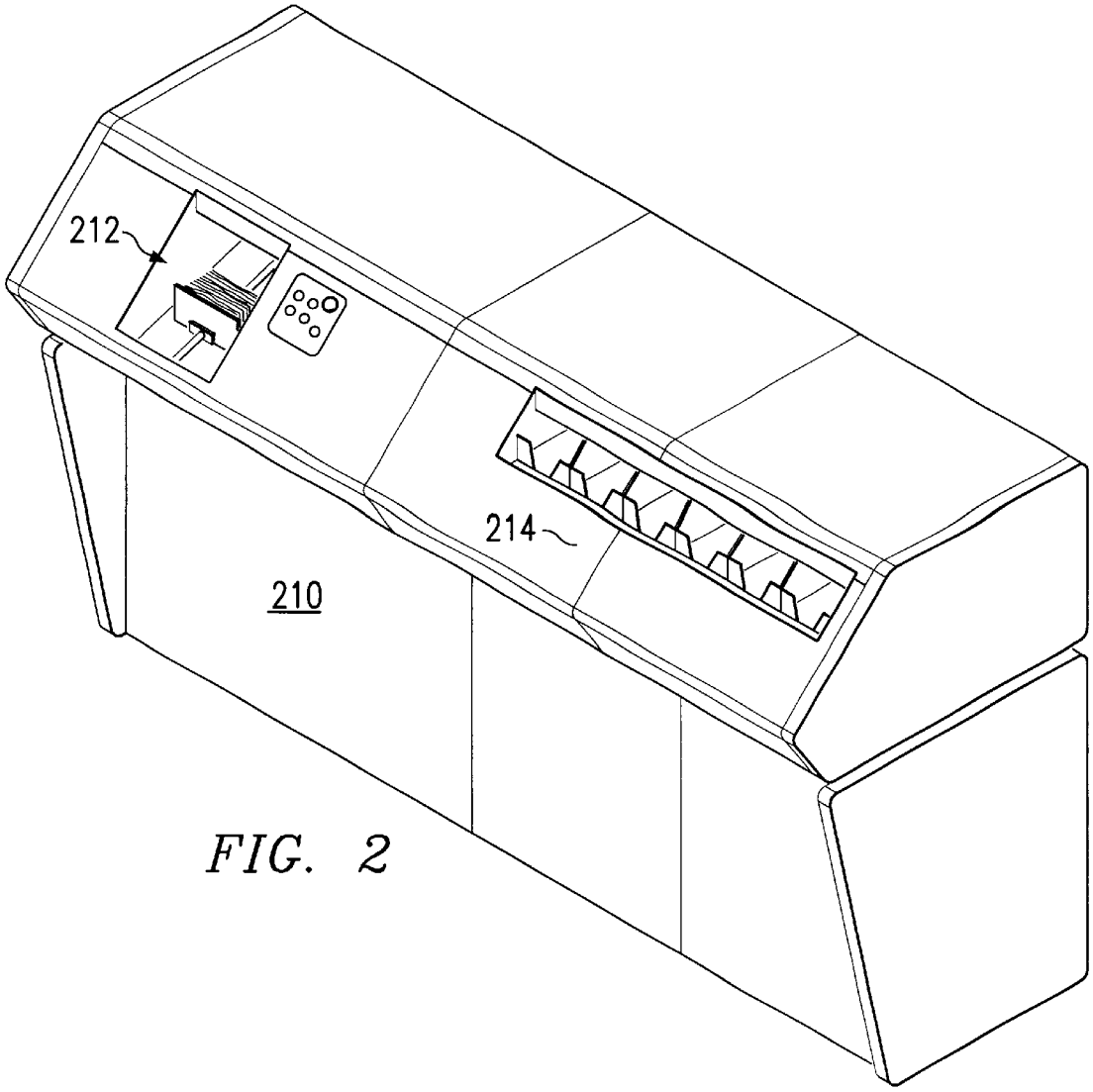
FIG. 2 is a perspective view of a currency processing machine loaded with a stack of currency.

FIG. 2 shows a currency processing machine 210 embodying the present invention and loaded with a batch feed of currency 212 prior to starting the currency processing cycle. This batch feed of currency 212 is fed into the currency processing machine one single note at a time. Single notes then travel on a conveyer part several different detectors before being deposited in one of the sort bins 214. Typically, a single sort bin is used to accumulate a single denomination of note at the end of the sort process.

Figure 1:
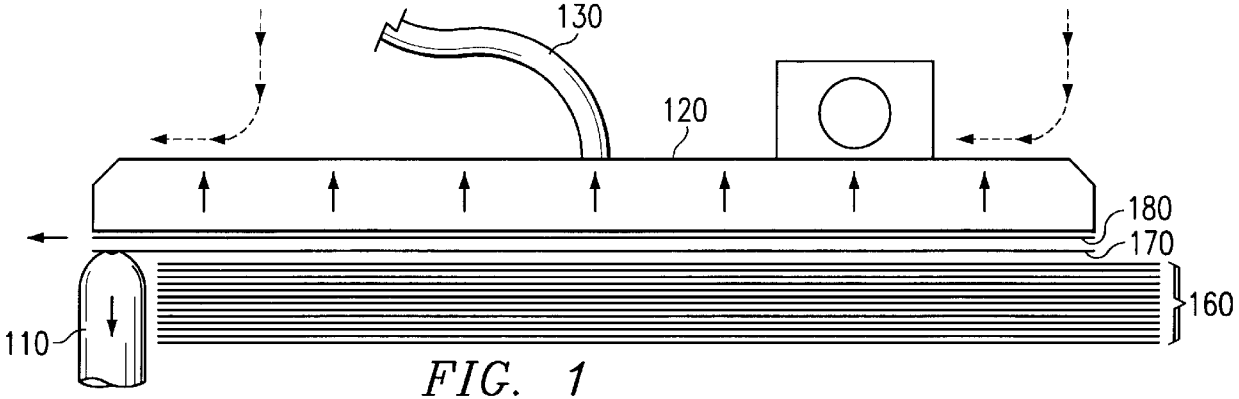
FIG. 1 depicts a schematic diagram of a prior art device for feeding currency notes into a currency processing machine.
Figure 3:
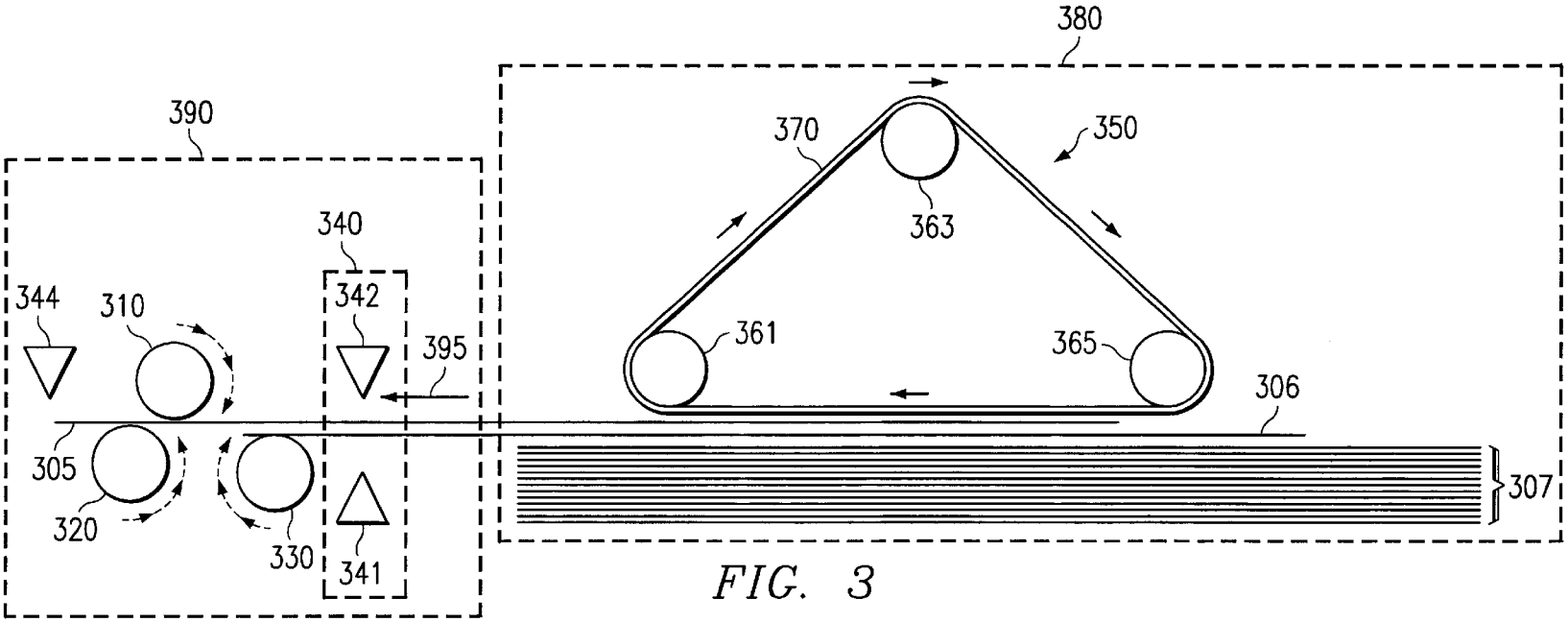
FIG. 3 depicts a schematic diagram of the currency note feeding apparatus according to the present invention.

Turning now to FIG. 3, a schematic diagram of a currently preferred embodiment of a currency note feeder 300 for feeding notes into a currency processing machine, such as the currency processing machine 210 illustrated in FIG. 2, is depicted. A belt drive 350 has three belt drive rollers 361, 363, 365 preferably arranged in a triangular pattern as shown in FIG. 3. Each belt drive roller 361, 363, 365 is preferably ½ of an inch in diameter and is preferably constructed of rubber. A feeder belt 370 is wrapped around the circumference of the three belt drive rollers 361, 363, 365. The feeder belt 370 is thus shaped into a triangular shape. Preferably, the feeder belt 370 forms an isosceles triangle with the base 371 coming into frictional contact with the uppermost note 305 in a stack of notes 307. The feeder belt base 371 is preferably approximately 10 inches long, with the total feeder belt 371 circumference preferably approximately 12 to 15 inches long. The feeder belt 370 is preferably constructed from a carbon based rubber with a fiber weave in the middle which is standard in the industry and well known to one skilled in the art. Furthermore, the feeder belt 370 is preferably 4 inches in width across the surface that contacts the First note 305.

The belt drive rollers 361, 363, 365 are connected to belt drive motors (not shown) that, when in operation, produce a torque on the belt drive rollers 361, 363, 365 thereby rotating belt the drive rollers 361, 363, 365 in a clockwise direction about their axes as viewed in FIG. 3. The rotation of the belt drive rollers 361, 363, 365 in turn propels the feeder belt 370 to also move in a clockwise direction. Because the feeder belt 370 is in frictional contact with the first note 305, the movement of the feeder belt 370 causes the first note 305 to be propelled to the left as the first note 305 is viewed in FIG. 3. The belt drive motors must be capable of producing varying amounts of torque in response to signals sent by the currency processing machine. By varying the amount of torque delivered by the belt drive motors, the speed of rotation of the belt drive rollers 361, 363, 365 can be adjusted thereby adjusting the speed of notes through the currency processing machine.

A first sensor 340 consisting of a pair of detectors 341, 342 is located next to the stack of notes 307. As the first note 305 moves to the left, the first sensor 340 detects that the first note 305 has moved out of the first feeding area 380 and into the second feeding area 390. In response to the determination that the note 305 has entered the second feeding area 390, a signal is sent to start a reverse roller 330. The reverse roller 330 is positioned away from the sensor 340 in a first direction 395, which is the direction of the note movement. The reverse roller 330 is also positioned in such a way as to make frictional contact with a second note 306 which is a note that has been moved inadvertently along with the first note 305 due to frictional contact between the first note 305 and the second note 306. The reverse roller 330 rotates in a direction such that it tends to move any note it is in contact with back toward the note stack 307 or at least tends to retard the motion of the note contacted by the reverse roller 330. Thus the note contacted by the reverse roller 330 is not fed into the transport rollers 310, 320 along with the first note 305. however, if only one note is being moved by the belt drive 350, the force exerted by the feeder belt 370 tending to propel the first note 305 in the first direction 395 is greater than the reversing force exerted on the first note 305 by the reverse roller 330. Therefore, the first note 305 will continue to be propelled in the first direction 395. This is because there is greater contacted surface area between the feeder belt 370 and first note 305 than there is between the reverse roller 330 and the first note 305. Also, the first note 305 will continue to be propelled in the first direction 395 because the feeder belt 370 is being driven by three belt motors each producing as much or more torque than the reverse motor (not shown) driving the reverse roller 330.

As the first note 305 continues, it comes in contact with the transport rollers 310, 320. The transport rollers 310, 320 are each connected to a transport motor (not shown). Each transport motor applies torque to the axis of its respective transport roller 310, 320 causing the transport rollers 310, 320 to rotate in a direction that tends to propel the first note 305 along the first direction 395. The transport rollers 310, 320 are positioned such that the first transport roller 310 contacts the opposite side of the first note 305 from that contacted by the second transport roller 320. The transport rollers 310, 320 rotate in opposite directions so that the resulting force propels the first note 305 in the first direction 395. As viewed in FIG. 3, the first transport roller 310 rotates in a clockwise direction and the second transport roller 320 rotates in a counterclockwise direction. The transport rollers 310, 320 are in continuous rotation during the operation of the currency processing machine.

A second sensor 344 is positioned linearly away from the transport rollers 310, 320 in the first direction 395. When the second sensor 344 first detects the presence of the first note 305 at the linear location marked by the second sensor 344, the reverse roller 330 and the belt driver 350 cease to move. Since the movement of the first note 305 is now controlled by the transport rollers 310, 320, the reverse roller 330 and the belt driver 350 are not needed. Also, since the second note 306 has been prevented from making contact with the transport rollers 310, 320 by the reverse roller 330, there is no danger of the second note 306 being pulled into the rest of the currency processing machine along with first note 305.

Figure 4:
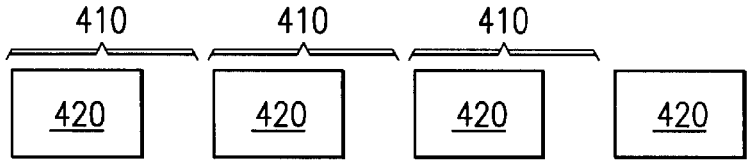
FIG. 4 illustrates the spacing between successive notes through the currency processing machine.

When the first sensor 342 detects that the first note 305 has cleared the feeder area 390, the belt drive 350 is started in motion again and the second note 306 is fed into the currency sorting machine in the save manner as the first note 305. In this way a constant spacing 410 between the leading edges of successive notes 420 is maintained as is illustrated in FIG. 4. However, if for some reason the currency sorting machine needs the leading edge to leading edge not spacing 410 to be adjusted to a greater distance, perhaps because the notes are excessively soiled or torn causing sorting to be slowed, then the starting of the belt drive 350 can be delayed for a specified period following receipt of the signal that the previous note has cleared the feeder area 390. Such specified period will be determined by the currency sorting machine. However, once a new spacing 410 has been determined, the note feeder 300 maintains this spacing until the currency processing machine determines that a new spacing 410 is required. Thus a constant spacing is maintained between spacing readjustments by the currency processing machine. It should be noted that the currency processing machine could adjust the spacing 410 to be closer together if, for example, it determines that the current group of notes being processed are less soiled and damaged than the previous groups of notes.

By allowing the spacing 410 between successive notes to be adjusted, depending on the quality of notes being processed as determined by the currency sorting machine, greater throughput is achieved without jams, which occur if notes are spaced to closely together. However, once the new spacing is determined, the new spacing between successive notes is consistently maintained until the currency sorting machine determines that the spacing should be readjusted.

The presently described invention is capable of providing notes to the currency sorting machine at whatever speed is required by the currency sorting machine because the motors controlling the belt drive rollers 361, 363, 365 are under the electronic control of the currency processing machine. Current currency sorting machines typically process notes in the range of 300 to 2400 notes per minute. For example, if the internal conveyer speed of the currency sorting machine is 600 notes per minute, then the speed of the belt 370 is 50 inches per second. Thus, if the diameter or the belt drive rollers 361, 363, 365 is ½ inch, then the belt drive rollers 361, 363, 365 must rotate at an angular speed of around 30 radians per second. As another example, if the internal conveyer speed of the currency sorting machine is 1200 notes per minute, then the speed of the belt 370 is 200 inches per second. As a final example, if the internal conveyer speed of the currency sorting machine is 2400 notes per minute, then the speed of the belt 370 is 400 inches per second.

It should be noted that the first sensor 340 as shown is an interruptible sensor (or interruptible photosensor) comprising a pair of detectors 341, 342. However, the first sensor 340 may be replaced with other types of detectors including, but not limited to other types of optical sensors and detectors. In fact, any means of detecting the presence or absence of a note would be acceptable.

The presently described invention provides for real time adjustment of the spacing between successive notes and for real time adjustment of the speed of notes fed into the currency processing machine. This is because the motors controlling the speed of rotation of the belt drive rollers 361, 363, 365 arc under the electronic control of the currency processing machine and may be finely adjusted. For example, if the currency processing machine determines that the optimal speed is 1363 notes per minute and the optimal note spacing to be 10.23 inches, the note feeder can be adjusted to meet this optimal state.

The description of the present invention has been presented for purposes of illustration and description, but is not limited to be exhaustive or limited to the invention in the form disclosed. Many modifications and variations will be apparent to those of ordinary skill in the art. The embodiment was chosen and described in order to best explain the principles of the invention the practical application to enable others of ordinary skill in the art to understand the invention for various embodiments with various modifications as are suited to the particular use contemplated.

What is claimed is:

1. A note feeder in a currency processing machine, comprising:

a transporter in a first feeder section for transporting a first note from a stack of notes onto a transport belt;

a first sensor in a second feeder section to identify the presence of said first note in said second feeder section;

a reversing transporter for removing extra notes from said first note;

a mediating transporter for moving said first note from said transporter onto a processing belt;

a second sensor in said second feeder section wherein said second sensor identifies when said first note has reached said processing belt; and a feedback controller receiving signals from the first and second sensors for controlling the operation of the transporter and the reversing transporter;

wherein the reversing transporter and the transporter are synchronized to operate and suspend operation at substantially the same time.

2. The note feeder as recited in claim 1 wherein said transporter is temporarily idle after said first note enters said mediating transporter.

3. The note feeder as recited in claim 2 wherein said transporter restarts after said first note has reached said processing belt.

4. The note feeder as recited in claim 3 wherein, responsive to a signal received from said currency processing machine, said transporter delays restarting for a specified time to adjust the spacing between successive notes.

5. The note feeder as recited in claim 1 wherein said transporter is a continuous loop of belt formed around belt drive rollers.

6. The note feeder as recited in claim 1 wherein said reversing transporter is a reversing roller.

7. The note feeder as recited in claim 6 wherein said reversing roller comprises a rubber material.

8. The note feeder as recited in claim 1 wherein said mediating transporter comprises at least one roller.

9. The note feeder as recited in claim 8 wherein said at least one roller comprises a rubber material.

10. The note feeder as recited in claim 1 wherein said first sensor comprises an interruptible photosensor.

11. The note feeder as recited in claim 1 wherein said second sensor comprises an optical sensor.

12. The note feeder as recited in claim 1 wherein said second sensor comprises an interruptible sensor.

13. A note feeder in a currency processing machine, comprising:

a transporter in a first feeder section for transporting a first note from a stack of notes onto a transport belt;

a first sensor in a second feeder section to identify the presence of said first note in said second feeder section;

a reversing transporter for removing extra notes from said first note;

a mediating transporter for moving said first note from said transporter onto a processing belt; and a second sensor in said second feeder section wherein said second sensor identifies when said first note has reached said processing belt;

wherein said reversing transporter is a reversing roller; and wherein said reversing roller starts in response to a determination that said first note has entered said second feeder section and stops in response to a determination that said first note is under the control of said mediating transporter; and wherein said reversing roller and said transporter are synchronized such that the reversing roller and the transporter being operation at substantially the same time and cease operation at substantially the same time.

14. A note feeder comprising:

at least one transport roller;

a transport belt in frictional contact with said at least on transport roller;

at least one reversing roller; and at least one sensor between said transport belt and said reversing roller;

wherein the at least one reversing roller and the at least one transport belt are synchronized such that the at least one reversing roller and the transport belt cease operation at substantially the same time.

15. The note feeder as recited in claim 14, wherein said at least one transport roller comprises three transport rollers arranged in a triangular shape thereby forming said transport belt into a triangular shape.

16. The note feeder as recited in claim 14 further comprising at least one mediating transport roller wherein said at least one mediating transport roller facilitates movement of a note from said transport belt to a processing area.

17. The note feeder as recited in claim 14 further comprising at least one second sensor between said reversing roller and a processing area.

* * * * *